US007737620B2

(12) United States Patent
Shin et al.

(10) Patent No.: US 7,737,620 B2
(45) Date of Patent: Jun. 15, 2010

(54) LIGHT EMISSION DEVICE, METHOD OF MANUFACTURING ELECTRON EMISSION UNIT FOR THE LIGHT EMISSION DEVICE, AND DISPLAY DEVICE HAVING THE LIGHT EMISSION DEVICE

(75) Inventors: Jong-Hoon Shin, Yongin-si (KR); Sang-Jin Lee, Yongin-si (KR); Su-Joung Kang, Yongin-si (KR); Jin-Ho Lee, Yongin-si (KR); Kyung-Sun Ryu, Yongin-si (KR); Kyu-Won Jung, Yongin-si (KR); Pil-Goo Jun, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 601 days.

(21) Appl. No.: 11/746,579

(22) Filed: May 9, 2007

(65) Prior Publication Data

US 2007/0267639 A1 Nov. 22, 2007

(30) Foreign Application Priority Data

May 19, 2006 (KR) ..... 10-2006-0045224
Nov. 20, 2006 (KR) ..... 10-2006-0114605

(51) Int. Cl.
*H01J 19/24* (2006.01)
*H01J 63/04* (2006.01)
*H01J 19/42* (2006.01)

(52) U.S. Cl. ..... 313/496; 313/495; 313/292

(58) Field of Classification Search ..... 313/495, 313/496, 497, 292

See application file for complete search history.

(56) References Cited

U.S. PATENT DOCUMENTS 5,063,327 A 11/1991 Brodie et al.

(Continued)

FOREIGN PATENT DOCUMENTS

CN 1287678 A 3/2001

(Continued)

OTHER PUBLICATIONS

Patent abstracts of Japan for publication 2004-146153, dated May 20, 2004, in the name of Yoichi Ando.

(Continued)

*Primary Examiner*—Karabi Guharay
(74) *Attorney, Agent, or Firm*—Christie, Parker & Hale, LLP

(57) ABSTRACT

A light emission device and a display device having the light emission device are provided. The light emission device includes: a first substrate and a second substrate facing the first substrate; a plurality of first electrodes and a plurality of second electrodes on an inner surface of the first substrate, the first electrodes crossing the second electrodes; a plurality of electron emission regions electrically connected to the first electrodes at crossing regions where the first electrodes cross the second electrode; a light emission unit on an inner surface of the second substrate; and at least one spacer between the first and second substrates, Here, a shortest distance D between the spacer and the electron emission regions satisfies the following condition:

$$500\ \mu m \leq D \leq 0.2Dh,$$

where, Dh is a diagonal length of at least one of the crossing regions.

17 Claims, 9 Drawing Sheets

U.S. PATENT DOCUMENTS

2007/0138939 A1* 6/2007 Jin ..... 313/495

FOREIGN PATENT DOCUMENTS

| | | | |
|---|---|---|---|
| CN | 1288583 | A | 3/2001 |
| CN | 1758412 | A | 4/2006 |
| EP | 0 690 472 | A1 | 1/1996 |
| EP | 1 619 713 | A1 | 1/2006 |
| EP | 1 696 465 | A1 | 8/2006 |
| JP | 10-508120 | T | 8/1998 |
| JP | 2000-251785 | | 9/2000 |
| JP | 2003-308797 | | 10/2003 |
| JP | 2004 146153 | | 5/2004 |
| JP | 2004-178841 | | 6/2004 |
| JP | 2004-311243 | | 11/2004 |
| JP | 2005-44705 | | 2/2005 |
| JP | 2005-183019 | | 7/2005 |
| JP | 2006-19245 | | 1/2006 |
| JP | 2006-86038 | | 3/2006 |
| KR | 10-2004-0034251 | | 4/2004 |
| KR | 10-2006-0001503 | | 1/2006 |
| KR | 10-2006-0037650 | | 5/2006 |
| WO | WO 2004/090930 | A1 | 10/2004 |

OTHER PUBLICATIONS

Patent abstracts of Japan for publication 2006-019245, dated Jan. 19, 2006, in the name of Kyochoru Jo.

Patent abstracts of Japan for publication 2006-086038, dated Mar. 30, 2006, in the name of Yukinori Ueda, et al.

Korean Patent Abstracts, Publication No. 1020060037650 A, dated May 3, 2006, in the name of Chun Gyoo Lee et al.

Patent Abstracts of Japan, Publication No. 2005-044705; Date of Publication: Feb. 17, 2005; in the name of Masayasu Hayashi et al.

Korean Patent Abstracts, Publication No. 1020040034251 A; Date of Publication: Apr. 28, 2004; in the name of Pil Su Ahn, et al.

Korean Patent Abstracts, Publication No. 1020060001503 A; Date of Publication: Jan. 6, 2006; in the name of Kyu Won Jung.

European Search Report dated Aug. 21, 2007 for corresponding European Patent Application No. 07108502.1.

* cited by examiner

LIGHT EMISSION DEVICE, METHOD OF MANUFACTURING ELECTRON EMISSION UNIT FOR THE LIGHT EMISSION DEVICE, AND DISPLAY DEVICE HAVING THE LIGHT EMISSION DEVICE

CROSS-REFERENCES TO RELATED APPLICATIONS

This application claims priority to and the benefit of Korean Patent Applications Nos. 10-2006-0045224 and 10-2006-0114605 filed on May 19, 2006 and Nov. 20, 2006, respectively, in the Korean Intellectual Property Office, the entire contents of which are incorporated herein by reference.

BACKGROUND OF THE INVENTION

1. Field of the Invention

The present invention relates to a light emission device and a display device.

2. Description of Related Art

A display device having a passive type display panel, such as a liquid crystal display panel, requires a light source for emitting light to the display panel. Generally, a cold cathode fluorescent lamp (CCFL) type light emission device and a light emitting diode (LED) type light emission device have been widely used as the light source.

Since the CCFL type light emission device and the LED type light emission device are respectively a line type light source and a point type light source, they have a plurality of optical members for diffusing light. The optical members may cause a light loss as the light passes through the optical members, and thus the CCFL type light emission device and the LED type light emission device should be applied with a relatively high voltage in order to obtain a sufficient luminance. This, however, makes it difficult to enlarge the display device.

Recently, a light emission device including a first substrate on which an electron emission unit having electron emission regions and driving electrodes is provided, and a second substrate on which a phosphor layer and an anode electrode are formed has been proposed as a substitute for the CCFL type light emission device and the LED type light emission device. This light emission device emits visible light by exciting the phosphor layer using electrons emitted from the electron emission regions.

In the light emission device, a sealing member is provided between peripheries (or periphery regions) of the first and second substrates to seal them together, thus forming a vacuum vessel. A plurality of spacers are arranged between the first and second substrates to withstand compression force applied to the vacuum vessel.

When the light emission device is used as the light source of the display device, important optical properties are to (a) make it possible to realize a high luminance with relatively lower power consumption, (b) emit light with uniform intensity throughout an active area, and (c) improve a display quality (e.g., contrast ratio) of an image realized by the display device.

In the conventional light emission device, a surface of the spacer may be charged with electricity due to the electrons emitted from the electron emission regions and colliding with the spacer. In this case, an electron beam path is distorted around the spacer and thus an excessively large or small amount of light is emitted from the phosphor layer around the spacer. As a result, the light emission uniformity may be deteriorated around the spacer.

SUMMARY OF THE INVENTION

Aspects according to exemplary embodiments of the present invention are directed to a light emission device that is designed to improve a luminance uniformity by suppressing the distortion of an electron beam path and also a contrast ratio of an image realized by a display device, and a display device using the light emission device as a light source.

Aspects according to exemplary embodiments of the present invention are directed to a light emission device in which a distance between a spacer and an electron emission region is configured to improve a luminance uniformity by suppressing the distortion of an electron beam path and also a contrast ratio of an image realized by a display device, and a display device using the light emission device as a light source.

In an exemplary embodiment of the present invention, a light emission device includes: a first substrate and a second substrate facing the first substrate; a plurality of first electrodes and a plurality of second electrodes located at a side of the first substrate facing the second substrate, the first electrodes crossing the second electrodes; a plurality of electron emission regions electrically connected to the first electrodes at crossing regions where the first electrodes cross the second electrode; a light emission unit located at a side of the second substrate facing the first substrate; and a spacer located between the first and second substrates. Here, a shortest distance D between the spacer and the electron emission regions satisfies the following condition:

$$500\ \mu m \leqq D \leqq 0.2Dh,$$

where, Dh is a diagonal length of at least one of the crossing regions.

In one embodiment, the spacer has a height ranging from 5 to 20 mm. In one embodiment, the light emission unit includes an anode electrode applied with a voltage ranging from 10 to 15 kV and a phosphor layer on one side of the anode electrode.

In one embodiment, the light emission device further includes an insulation layer located between the first and second electrodes, wherein the second electrodes are located above the insulation layer, wherein a plurality of openings are formed in the second electrodes and the insulation layer at the crossing regions, and wherein the electron emission regions are disposed on the first electrodes in the openings of the insulation layer. In one embodiment, the spacer is located at an outer side portion of a diagonal corner of the at least one of the crossing regions. In one embodiment, the second electrodes are parallel to each other and spaced apart from each other by a distance ranging from 100 to 400 μm. In one embodiment, the insulation layer has a thickness ranging from 15 to 30 μm. In one embodiment, each of the openings formed in the insulation layer and the second electrodes has a diameter ranging from 30 to 50 μm.

In another exemplary embodiment of the present invention, a method of manufacturing an electron emission unit of a light emission device is provided. The method includes: forming a plurality of first electrodes in a stripe pattern on a substrate; forming an insulation layer on the substrate, the insulation layer covering the first electrodes and having a thickness ranging from 15 to 30 μm; forming a plurality of second electrodes in a stripe pattern crossing the first electrodes on the insulation layer, the second electrodes being spaced apart from each other by a distance ranging from 100 to 400 μm;

forming a plurality of openings in the second electrodes and the insulation layer at crossing regions where the first and second electrodes cross each other, the openings of the second electrodes exposing the corresponding openings of the insulation layer; and forming a plurality of electron emission regions on the first electrodes in the openings of the insulation layer.

In one embodiment, the second electrodes are formed through a screen-printing process.

In one embodiment, the forming of the insulation layer includes forming a plurality of first openings by partly wet-etching the insulation layer through a plurality of openings of a first mask layer and forming a plurality of second openings by further wet-etching base regions of the first openings through a plurality of openings of a second mask layer, each of the openings of the second mask layer being smaller than each of the openings of the first mask layer.

In another exemplary embodiment of the present invention, a display device includes a display panel for displaying an image; and a light emission device for emitting light toward the display panel. The light emission device includes: a first substrate and a second substrate facing the first substrate; a plurality of first electrodes and a plurality of second electrodes located at a side of the first substrate facing the second substrate, the first electrodes crossing the second electrodes; a plurality of electron emission regions electrically connected to the first electrodes at crossing regions where the first electrodes cross the second electrode; a light emission unit located at a side of the second substrate facing the first substrate; and a spacer located between the first and second substrates. Here, a shortest distance D between the spacer and the electron emission regions satisfies the following condition:

$$500\ \mu m \leqq D \leqq 0.2Dh,$$

where, Dh is a diagonal length of at least one of the crossing regions.

In one embodiment, the spacer has a height ranging from 5 to 20 mm; and the light emission unit includes an anode electrode applied with a voltage ranging from 10 to 15 kV and a phosphor layer formed on one side of the anode electrode.

In one embodiment, the display device further includes an insulation layer located between the first and second electrodes, wherein the second electrodes are located above the insulation layer, wherein a plurality of openings are formed in the second electrodes and the insulation layer at the crossing regions, and wherein the electron emission regions are disposed on the first electrodes in the openings of the insulation layer. In one embodiment, the spacer is located at an outer side portion of a diagonal corner of the at least one of the crossing regions. In one embodiment, the second electrodes are parallel to each other and spaced apart from each other by a distance ranging from 100 to 400 μm. In one embodiment, the insulation layer has a thickness ranging from 15 to 30 μm; and each of the openings formed in the insulation layer and the second electrodes has a diameter ranging from 30 to 50 μm.

In one embodiment, the display panel has a plurality of first pixels, and the light emission device has a plurality of second pixels, wherein the second pixels are less in number than the first pixels, and wherein an intensity of light emission of each of the second pixels is independently controlled.

In an exemplary embodiment of the present invention, a light emission device includes: a first substrate and a second substrate facing the first substrate; a first electrode and a second electrode located at side of the first substrate facing the second substrate, the first electrode crossing the second electrode; a plurality of electron emission regions electrically connected to the first electrode at a crossing region where the first electrode crosses and the second electrode; a light emission unit located at a side of the second substrate facing the first substrate; and a spacer located between the first and second substrates. Here, a shortest distance D between the spacer and the electron emission regions satisfies the following condition:

$$500\ \mu m \leqq D \leqq 0.2Dh,$$

where, Dh is a diagonal length of the crossing region.

In one embodiment, the light emission device further includes an insulation layer located between the first and second electrodes, wherein the second electrode is located above the insulation layer, wherein a plurality of openings are formed in the second electrode and the insulation layer at the crossing region, and the electron emission regions are disposed on the first electrode in the openings of the insulation layer.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
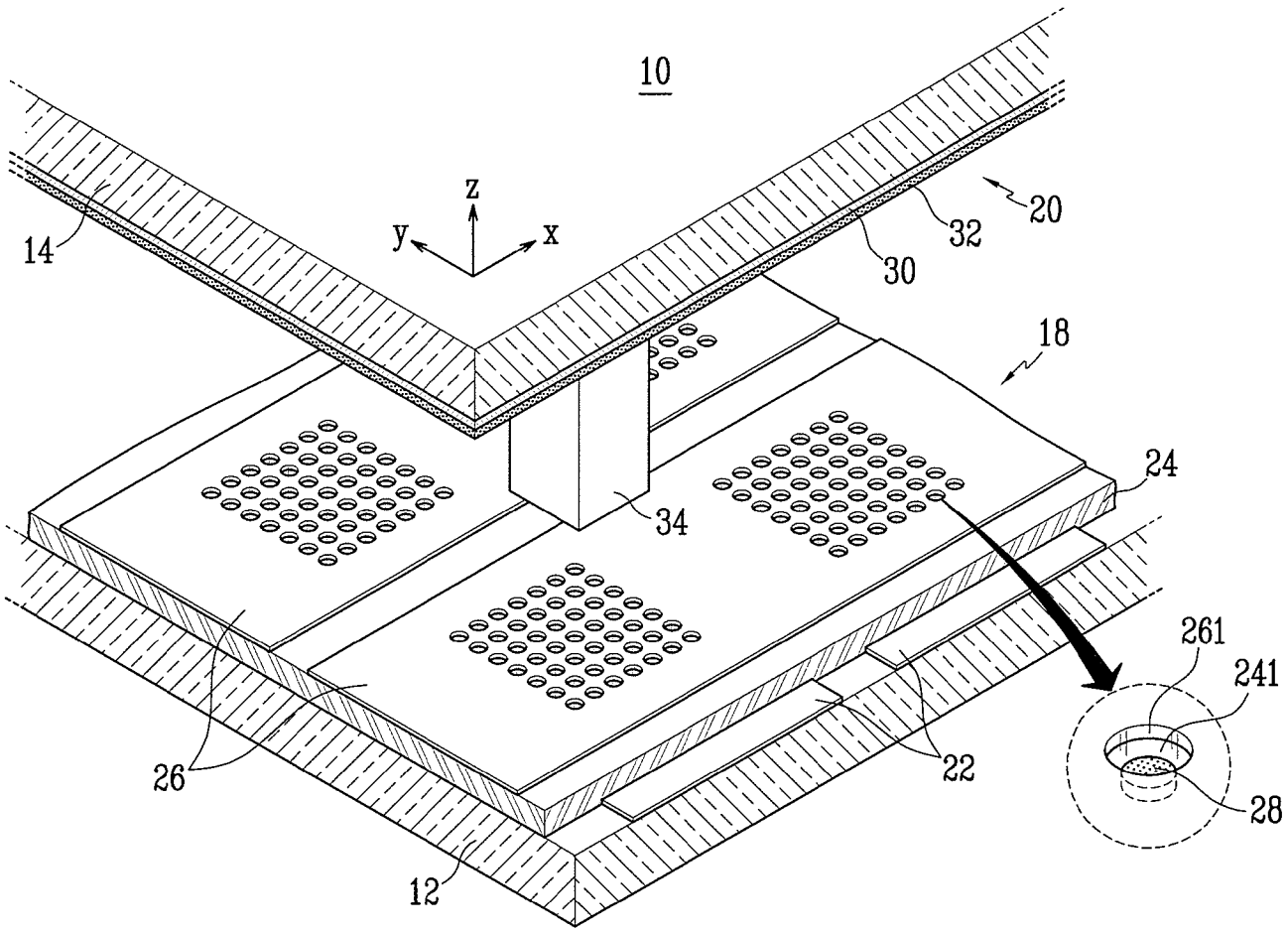
FIG. 1 is a partial perspective view of a light emission device according to an exemplary embodiment of the present invention.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. In addition, when an element is referred to as being "on" another element, it can be directly on the another element or be indirectly on the another element with one or more intervening elements interposed therebetween. Hereinafter, like reference numerals refer to like elements.

Figure 2:
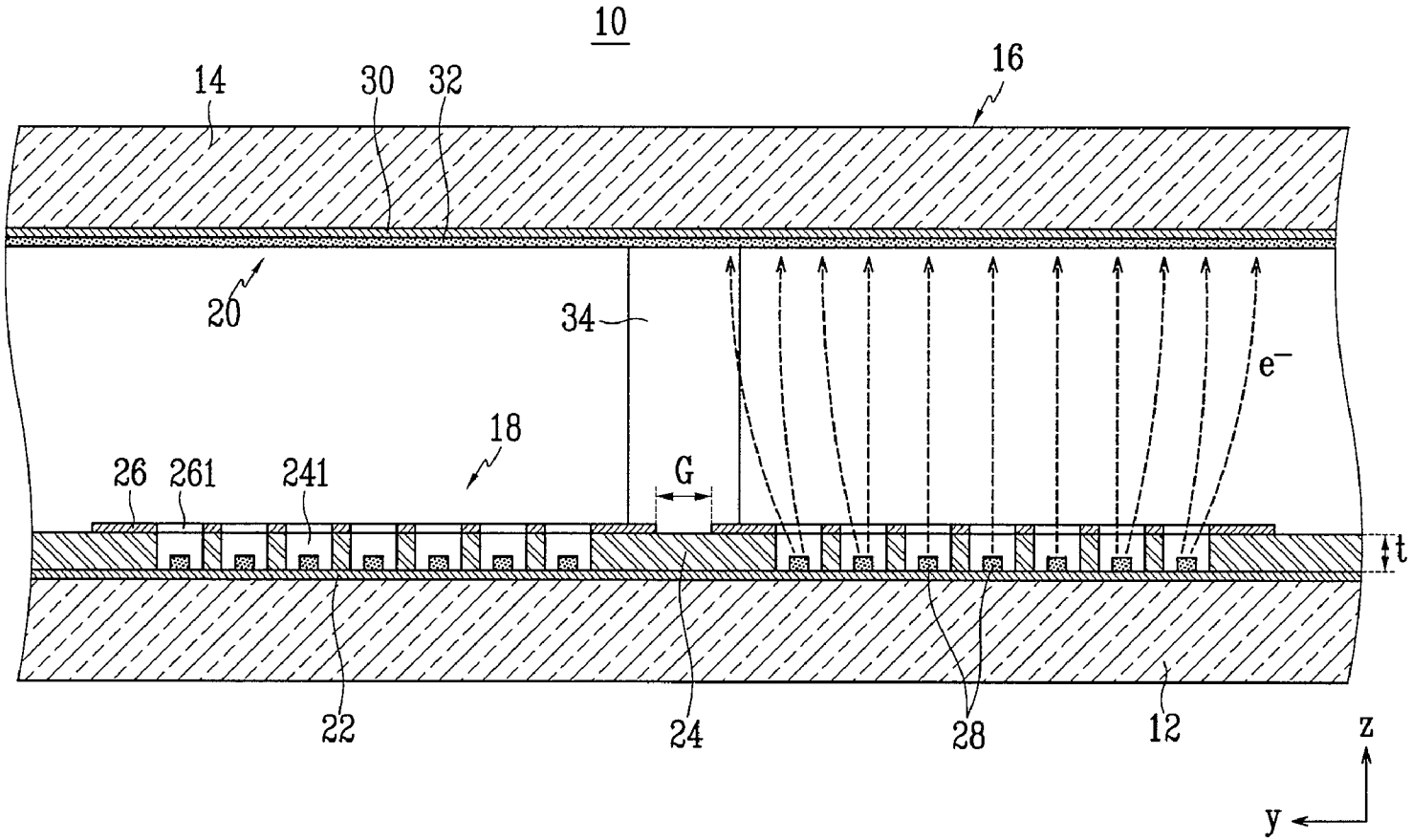
FIG. 2 is a partial sectional view of the light emission device of FIG. 1.
Figure 3:
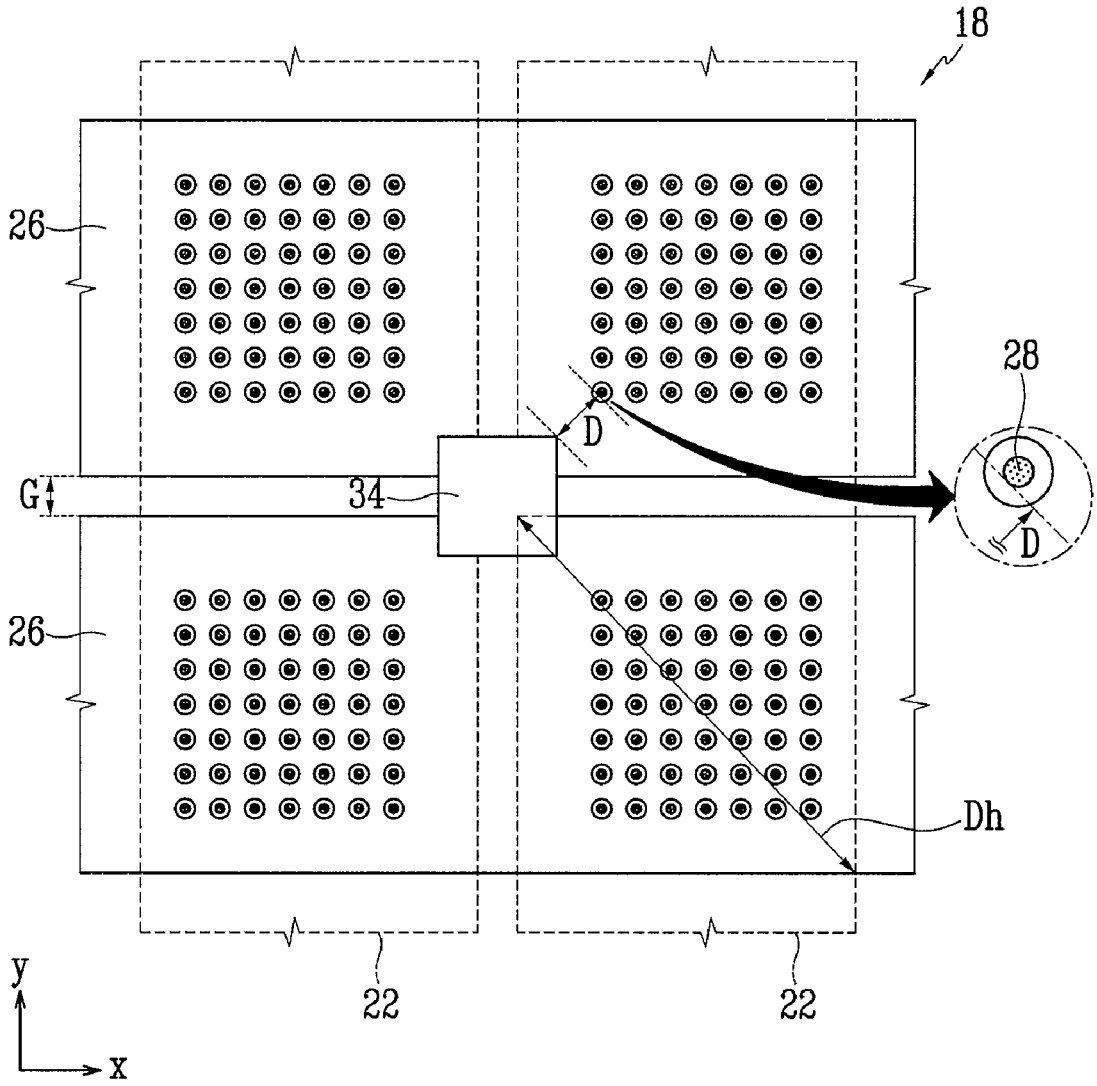
FIG. 3 is a partial plan view of an electron emission unit of the light emission device of FIGS. 1 and 2.

Referring to FIGS. 1 through 3, a light emission device 10 according to an exemplary embodiment of the present invention includes a vacuum vessel 16 having first and second substrates 12 and 14 facing each other in a parallel manner with a distance therebetween (wherein this distance may be predetermined). A sealing member is provided between peripheries (or periphery portions) of the first and second substrates 12 and 14 to seal them together to thus form the vacuum vessel 16. The interior of the vacuum vessel 16 is kept to a degree of vacuum of about $10^{-6}$ Torr.

An electron emission unit 18 for emitting electrons toward the second substrate 14 is located on an inner surface of the first substrate 12 and a light emission unit 20 for emitting visible light by utilizing the electrons is located on an inner surface of the second substrate 14.

The electron emission unit 18 includes first and second electrodes 22 and 26 that are arranged in stripe patterns crossing (or intersecting) each other with an insulation layer 24 interposed therebetween, and electron emission regions 28 that are electrically connected to the first electrodes 22.

Openings 261 and openings 241 are respectively formed in the second electrodes 26 and the insulation layer 24 at respective regions where the first and second electrodes 22 and 26 cross (or intersect) each other, thereby partly exposing the surface of the first electrodes 22. The electron emission regions 28 are located on the first electrodes 22 in the openings 241 of the insulation layer 24. The first electrodes 22 contacting the electron emission regions 28 are cathode electrodes that can apply a current to the electron emission regions 28, and the second electrodes 26 are gate electrodes for inducing the electron emission by forming an electric field using a voltage difference with the cathode electrodes.

Among the first and second electrodes 22 and 26, the electrodes (e.g., the second electrodes 26) extending in a row direction (an x-axis in FIG. 1) of the light emission device 10 function mainly as scan electrodes applied with a scan driving voltage and the electrodes (e.g., first the electrodes 22) extending in a column direction (a y-axis in FIG. 1) of the light emission device 10 function as data electrodes applied with data driving voltage.

The electron emission regions 28 are formed of a material for emitting electrons when an electric field is formed around thereof under a vacuum atmosphere, such as a carbon-based material and/or a nanometer-sized material. For example, the electron emission regions 28 may includes at least one material selected from the group consisting of carbon nanotubes, graphite, graphite nanofibers, diamonds, diamond-like carbon, fullerene $C_{60}$, silicon nanowires, and combinations thereof.

In an embodiment of the above-described structure, each of the regions where the first electrodes 22 cross (or intersect) the second electrodes 26 corresponds to a single pixel area of the light emission device 10.

Alternatively, two or more of the intersecting regions may correspond to the single pixel area. In this case, two or more of the first electrodes 22 and/or two or more of the second electrodes 26, which correspond to the single pixel area, are electrically connected to each other to receive a common driving voltage.

The light emission unit 20 includes an anode electrode 30 and a phosphor layer 32 located on one side of the anode electrode 30. The phosphor layer 32 may be formed of a mixture of red, green, and blue phosphors to emit white light. The phosphor layer 32 may be formed on an entire active area of the second substrate 14 or in a pattern having a plurality of sections corresponding to pixel areas (wherein the pattern may be predetermined).

The anode electrode 30 is formed by a transparent conductive layer such as an indium tin oxide (ITO) layer. The anode electrode 30 is an acceleration electrode that pulls electrons emitted from the electron emission regions 28 toward the phosphor layer 32 by receiving a high voltage. The phosphor layer 32 may be covered by a metal reflective layer. The metal reflective layer enhances the screen luminance by reflecting the visible light, which is emitted from the phosphor layer 32 to the first substrate 12, toward the second substrate 14.

Disposed between the first and second substrates 12 and 14 are spacers 34 adapted to withstand a compression force applied to the vacuum vessel 16 and to uniformly maintain a gap between the first and second substrates 12 and 14. The spacer 34 may be formed in a variety of structural types such as a rectangular pillar type, a circular pillar type, and/or a bar type. Each of the spacer 34 is located at an outer side (or outer side portion) of the crossing (or intersecting) region of the first and second electrodes 22 and 26.

In one embodiment, when the spacers 34 are pillar type spacers, the spacer 34 may be located at a portion defined between the first electrodes 22 and defined between the second electrodes 26, i.e., at an outer side of a diagonal corner of each pixel area. In addition, in order to reduce the number of the spacers 34, each of the spacers 34 may be designed to have a relatively large width. In this case, the width of the spacer 34 is greater than a distance (G of FIG. 2.) between the adjacent second electrodes 26 to contact the second electrodes 26.

In the light emission device 10, the plurality of pixel areas are formed by the combination of the first and second electrodes 22 and 26 that are driving electrodes. The light emission device 10 is driven by applying driving voltages (that may be predetermined) to the first and second electrodes 22 and 26 and by applying a positive direct current (DC) voltage (anode voltage) at thousands of volts or more to the anode electrode 30.

Electric fields are formed around the electron emission regions 28 at the pixels where the voltage difference between the first and second electrodes 22 and 26 is equal to or greater than the threshold value, and thus electrons ($e^-$) are emitted from the electron emission regions 28. The emitted electrons collide with a corresponding portion of the phosphor layer 32 of the relevant pixels by being attracted by the anode voltage applied to the anode electrode 30, thereby exciting the phosphor layer 32. A light emission intensity of the phosphor layer 32 for each pixel corresponds to an electron emission amount of the relevant pixel.

In the foregoing exemplary embodiment, the spacer 34 has a height ranging from about 5 to about 20 mm in a thickness direction (a z-axis in FIG. 1) of the light emission device 10. A spaced distance between the first and second substrates 12 and 14 substantially corresponds to the height of the spacer 34. Due to the relatively large distance between the first and second substrates 12 and 14, the arcing generation in the vacuum vessel 16 can be suppressed, and the anode electrode 30 can be applied with a voltage of 10 kV or more, and, in one embodiment, from 10 to 15 kV. The screen luminance of the light emission device 10 is proportional to the anode voltage.

Each region where the first and second electrodes 22 and 26 cross (or intersect) each other has a width ranging from several to tens of millimeters, and tens of electron emission regions 28 are located at each crossing (or interesting) region. By way of example, each crossing (or intersecting) region may have a 10 mm×10 mm size, each of the openings 261 of the second electrodes 26 may have a diameter ranging from 30 to 50 μm, and 20 or more of the electron emission regions 28 each having a diameter less than that of the opening 261 may be arranged at each crossing (or intersecting) region.

The above-described light emission device 10 can realize a luminance of 10,000 cd/m$^2$ at a central portion of the active area. That is, the light emission device 10 can realize a higher luminance with a lower electric power consumption as compared with a cold cathode fluorescent lamp (CCFL) type light emission device and a light emitting diode (LED) type light emission device.

In addition, since the electrons emitted from the electron emission regions 28 travel toward the second substrate 14 may be diffused, some of the electrons collide with the surface of the spacer 34, thereby charging the surface of the spacer 34. The charged spacer 34 distorts the electron beam path around the spacer 34. In the light emission device 10 of the present exemplary embodiment, a shortest distance (D of FIG. 3) between the spacer 34 and the electron emission regions 28 is configured (or defined) to satisfy the following equation 1.

$$500\ \mu m \leqq D \leqq 0.2Dh, \qquad \text{Equation 1}$$

where, Dh (see FIG. 3) is a diagonal length of the region where the first and second electrodes 22 and 26 cross (or intersect) each other.

Figure 4:
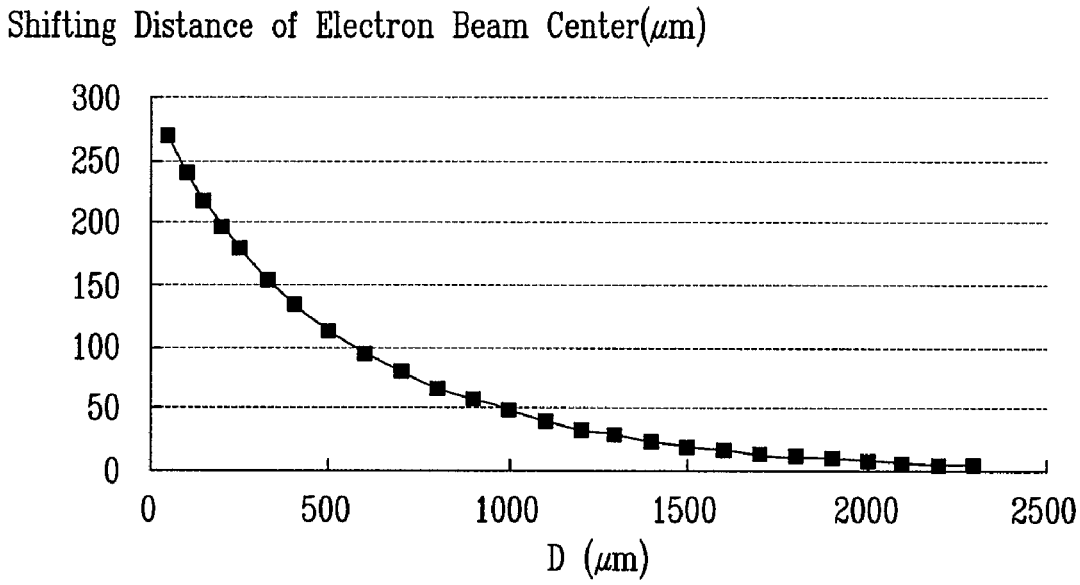
FIG. 4 is a graph illustrating a shifting distance of an electron beam center in accordance with a variation of a shortest distance D between a spacer and electron emission regions.

FIG. 4 is a graph illustrating a shifting distance of an electron beam center in accordance with a variation of the shortest distance D between the spacer and electron emission regions. The shift distance of the electron beam center may vary by being attracted toward the charged spacer or repelled away from the charged spacer as the electron beam travels around the charged spacer. A test was performed in a state where a voltage difference between the first and second electrodes 22 and 26 is 90V and a voltage of 10 kV is applied to the anode electrode 30.

Referring to FIG. 4, as the shortest distance D between the spacer and the electron emission regions is reduced, the shifting distance of the electron beam center increases due to the spacer charged with the electricity. When the shift distance of the electron beam center is greater than about 115 μm, a phenomenon where the phosphor layer around the spacer may emit an excessively larger or small amount of light may occur.

In the light emission device 10 of the present exemplary embodiment, as the shortest distance D between the spacer 34 and the electron emission regions 28 are set to be greater than about 500 μm so that the shifting distance of the electron beam center, which results from the spacer charged with electricity, is not to be greater than about 115 μm. Therefore, the light emission device 10 of the present exemplary embodiment can reduce (or minimize) the luminance variation around the spacer 34.

In addition, although the electron beam path distortion caused by the charged spacer can be effectively suppressed as the shortest distance D between the spacer 34 and the electron emission regions 28 increases, the number of electron emission regions 28 that can be disposed around the spacer 34 corresponding decreases. This decrease of the number of electron emission regions 28 causes the deterioration of the luminance around the spacer 34.

In the light emission device 10 according to the present exemplary embodiment, the shortest distance D between the spacer 34 and the electron emission regions 28 is configured (or designed) not to exceed 0.2Dh in consideration of a size of the crossing (or intersecting) region of the first and second electrodes 22 and 26, thereby ensuring that the luminance around the spacer 34 are not excessively lowered.

Figure 5:
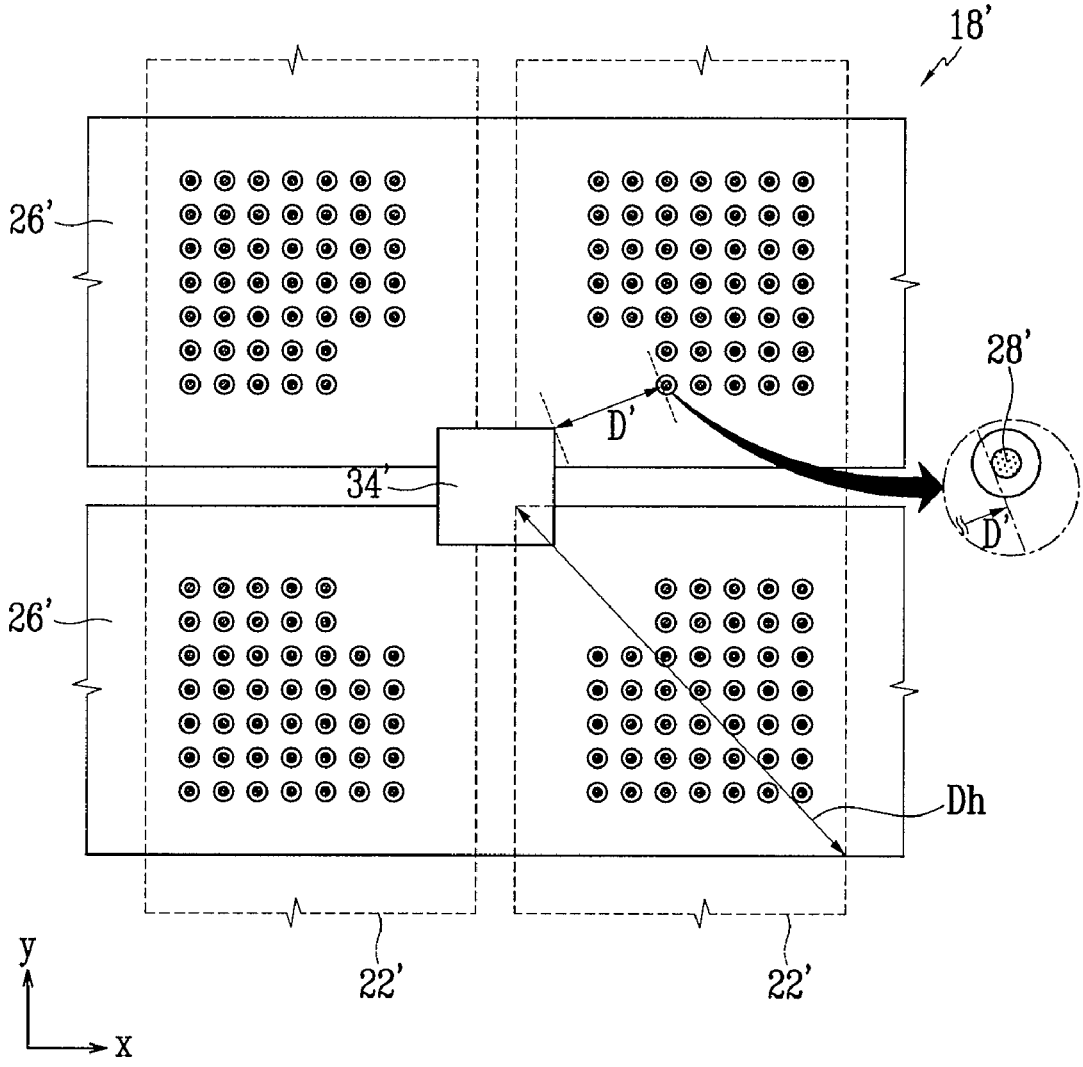
FIG. 5 is a partial plan view of an electron emission unit of a light emission device of a comparative example, in which a shortest distance D' between a spacer and electron emission regions is greater than 0.2Dh.
Figure 6:
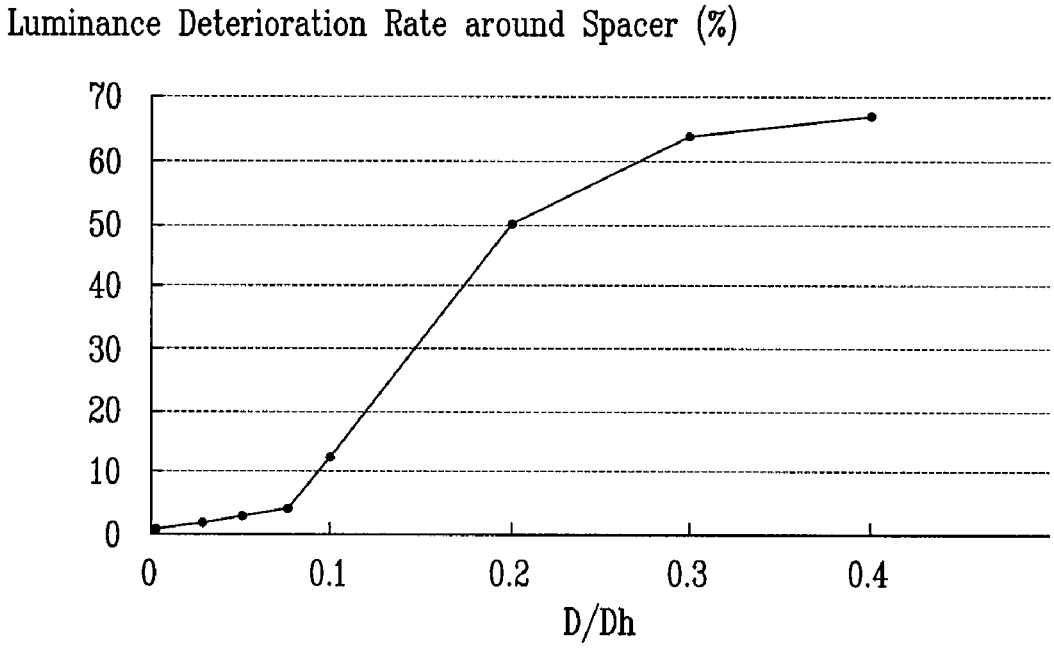
FIG. 6 is a graph illustrating a luminance deterioration rate around a spacer in accordance with a variation of a ratio (D/Dh) of a diagonal length of an intersecting region to a shortest distance between the spacer and electron emission regions.

FIG. 5 is a partial plan view of an electron emission unit of a light emission device of a comparative example, in which a shortest distance D' between a spacer and electron emission regions is greater than 0.2Dh, and FIG. 6 is a graph illustrating a luminance deterioration rate around a spacer in accordance with a variation of a ratio (D/Dh) of a diagonal length of an intersecting region to a shortest distance between the spacer and electron emission regions.

In FIG. 6, a luminance deterioration rate around the spacer represents a value relative to a maximum luminance that is observed at a portion of the active area of the light emission device, which is not adjacent to the spacer. A test was performed in a state where a voltage difference between the first and second electrodes 22 and 26 is 90V and a voltage of 10 kV is applied to the anode electrode 30.

Referring to FIG. 5, in an electron emission device of the comparative example, electron emission regions 28' cannot be disposed around a spacer 34'. Therefore, in a single crossing (or intersecting) region, a portion relatively close to the spacer 34' and a portion relatively far from the spacer 34' differ in a distribution of the electron emission regions 28'.

Therefore, as can be noted from the test result illustrated in FIG. 6, as the shortest distance D between the spacer and the electron emission regions increases, the luminance deterioration rate around the spacer increases, and, when the shortest distance D between the spacer and the electron emission regions becomes greater than 0.2Dh (e.g., D'), the luminance deterioration rate around the spacer becomes greater than 50%.

However, in the light emission device 10 of the present exemplary embodiment, since the shortest distance between the spacer 34 and the electron emission regions 28 is set to satisfy the above-described equation 1, the electron beam distortion resulting from the spacer 34 charged with electricity can be suppressed. Furthermore, the excessive luminance deterioration around the spacer 34 can be suppressed and thus the luminance uniformity of the active area can be improved.

In the present exemplary embodiment, in order to increases a process margin and to prevent (or protect itself from) a short circuit between the second electrodes 26, which may be generated during a manufacturing process, the second electrodes 26 are arranged in a parallel manner and spaced apart from each other by a distance (G of FIG. 2) of about 100 μm or more, and, in one embodiment, from 100 to 400 μm. In one embodiment, if the distance between the adjacent second electrodes 26 is less than about 100 μm, the process margin is reduced and a short circuit may be generated between the adjacent second electrodes 26 during a patterning process. In another embodiment, if the distance between the adjacent second electrodes 26 is greater than about 400 μm, it is difficult to form the proper number of pixels in the light emission device 10.

In the present exemplary embodiment, the insulation layer 24 may have a thickness (t of FIG. 2) of about 15 μm or more, and, in one embodiment, ranging from 15 to 30 μm. When the insulation layer 24 satisfies this thickness condition, the withstanding voltage property of the first and second electrodes 22 and 26 is improved to stabilize the driving of the light emission device 10. Furthermore, even when a material (i.e., a metal material) of the first electrodes 22 is diffused into the insulation layer 24 during a process for forming the insulation layer 24, the withstanding voltage property of the insulation layer 24 is not deteriorated.

The openings 241 are formed in the insulation layer 24 in a state where the insulation layer 24 is formed to be relatively thick as described above. If the openings 241 are formed by a wet-etching process, a width of the opening 241 at a bottom of the insulation layer 24 may be small due to the isotropic etching property where a width of the opening is gradually reduced as a depth of the opening increases. That is, a sidewall defining the opening of the insulation layer is not vertically formed but inclined or concaved.

According to the exemplary embodiment of the present invention, the sidewall defining the opening 241 of the insulation layer 24 can be almost vertically formed through a secondary wet-etching process that will be described hereinafter in more detail. Through this secondary wet-etching process, the openings 261 and the openings 241, each of which has a relatively small diameter ranging from about 30 to about 50 μm, can be formed in the second electrodes 26 and the insulation layer 24, respectively.

The following will describe a method of manufacturing the electron emission unit according to an exemplary embodiment of the present invention with reference to FIGS. 7A through 7F.

Figure 7A:
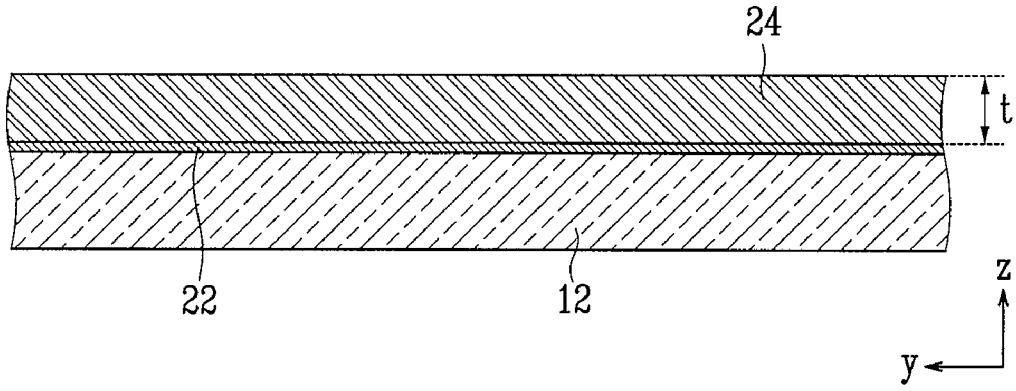
FIGS. 7A, 7B, 7C, 7D, 7E, and 7F are partial sectional views illustrating a method of manufacturing the electron emission unit of the light emission device of FIGS. 1 and 2.

Referring to FIG. 7A, a conductive layer is formed on the first substrate 12 and patterned in a strip pattern to form the first electrodes 22. An insulation material is deposited on the first substrate 12 while covering the first electrodes 22, thereby forming the insulation layer 24 having a thickness t of about 15 μm or more, and, in one embodiment, from 15 to 30 μm. The insulation layer 24 is formed by repeating more than two times a screen-printing process, a drying process, and a baking process so as to obtain such a thickness.

Figure 7B:
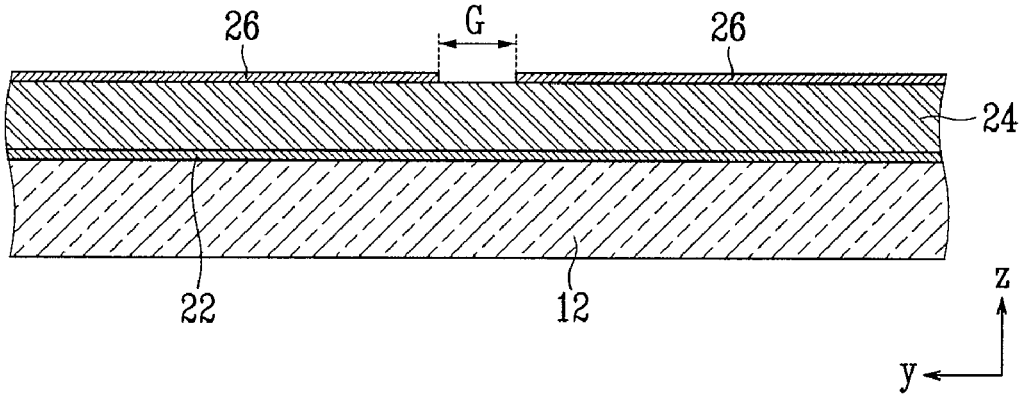

Referring to FIG. 7B, a conductive layer is screen-printed on the insulation layer 24 in a stripe pattern to form the second electrodes 26 intersecting the first electrodes 22. At this point, the distance G between the adjacent second electrodes 26 is about 100 μm or more, and, in one embodiment, from 100 to 400 μm. If the second electrodes 26 are formed through the screen-printing process, a patterning process such as a photolithography may be omitted.

Figure 7C:
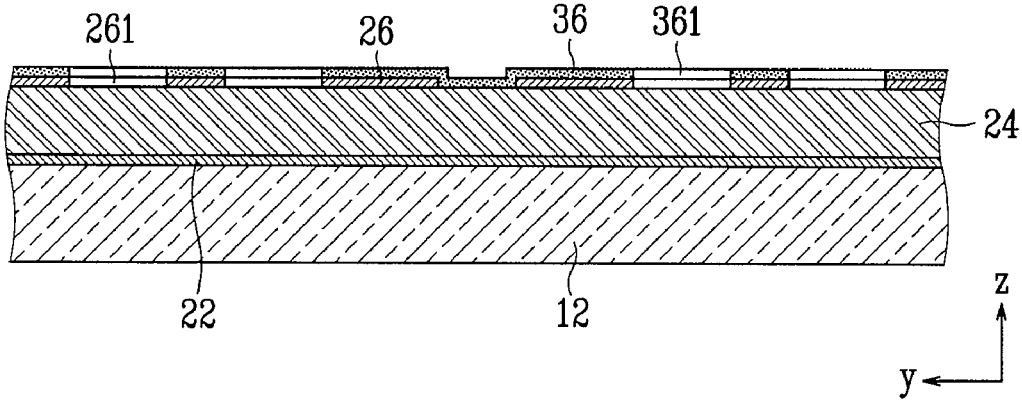

Referring to FIG. 7C, a first mask layer 36 is entirely formed on the insulation layer 24 while covering the second electrodes 26 and patterned to form openings 361 in which the electron emission regions will be formed. An exposed portion of the second electrodes 26 exposed by the openings 361 is etched to form the openings 261.

Figure 7D:
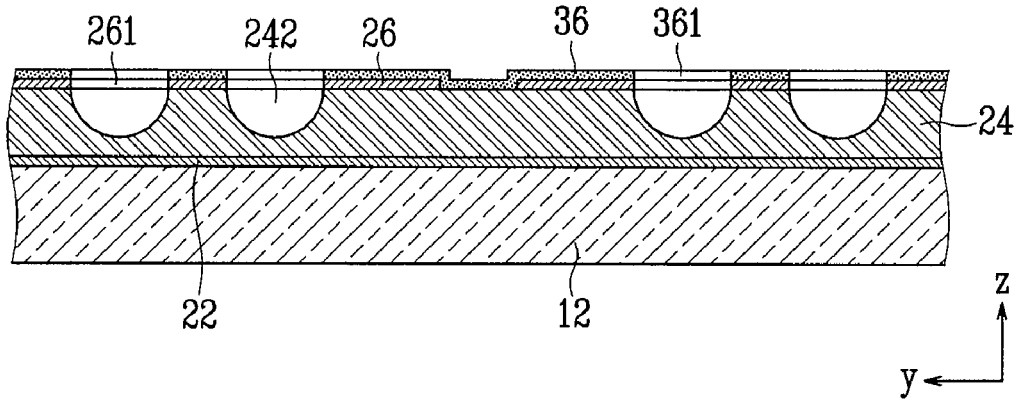

Referring to FIG. 7D, an exposed portion of the insulation layer 24 exposed by the openings 261 of the second electrodes 26 is etched by a primary wet-etching process to form the first openings 242. At this point, since the insulation layer 24 is relatively thick, the openings 242 are not formed to completely penetrate the insulation layer 24 but partly formed in the insulation layer 24. Next, the first mask layer 36 is removed.

Figure 7E:
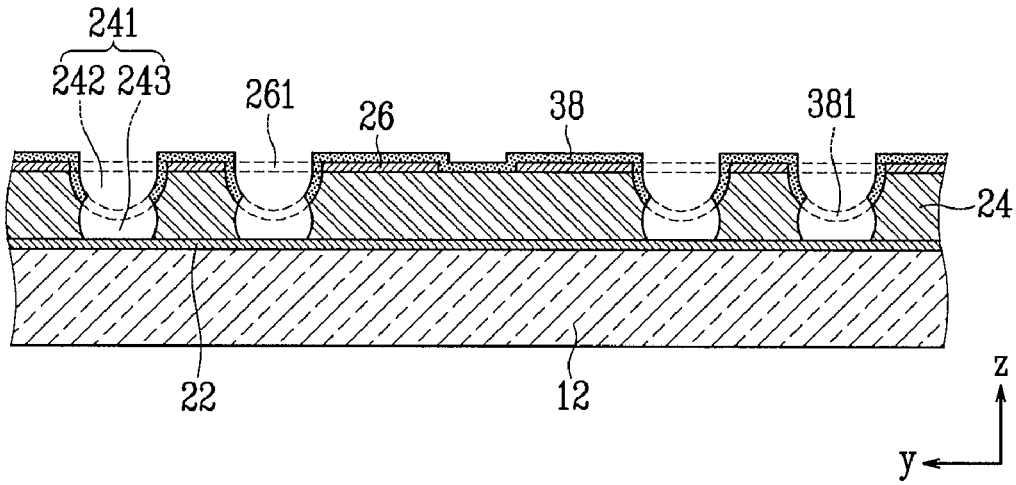

Referring to FIG. 7E, a second mask layer 38 is entirely formed on the insulation layer 24 while covering the second electrode 26 and patterned to form openings 381 in which the electron emission regions will be formed. A width of each opening 381 of the second mask layer 38 may be less than that of each opening 361 of the first mask layer 36. In this case, the second mask layer 38 is located over the periphery of each sidewall of the first opening 242.

Next, an exposed portion of the insulation layer 24 by the openings 381 of the second mask layer 38 is etched by a secondary wet-etching process to form the second openings 243 penetrating the insulation layer 24. Subsequently, the second mask layer 38 is removed. By performing the two wet-etching processes (or a wet-etching process twice), the openings 241 having the sidewall that is substantially or relatively vertical to the insulation layer 24 can be formed without enlarging a width of each of the openings 261 and 241 of the second electrodes 26 and the insulation layer 24.

Figure 7F:
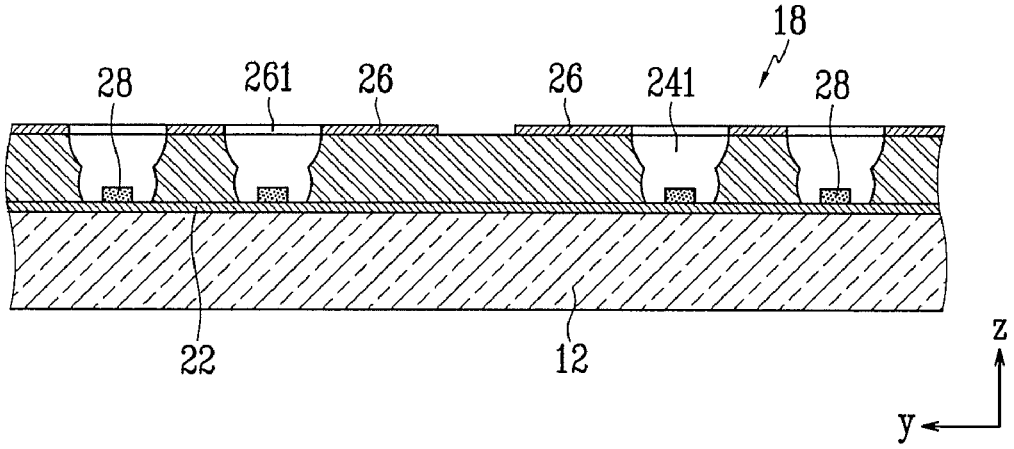

Referring to FIG. 7F, the electron emission regions 28 are formed on the first electrodes 22 in the openings 241 of the insulation layer 24. In order to form the electron emission regions 28, a screen-printing process, in which a paste mixture having a viscosity that is proper for printing is prepared by mixing solvent (or solvent vehicle) and binder with an electron emission material such as carbon nanotubes, graphite, graphite nanofibers, diamond, diamond-like-carbon, fullerene ($C_{60}$), and/or silicon nanowires. The mixture is screen-printed in the openings 241 of the insulation layer 24, dried, and/or baked.

However, the present invention is not limited to this screen printing process. For example, a direct growth process, a sputtering process, and/or a chemical vapor deposition process may be used to form the electron emission regions 28.

Figure 8:
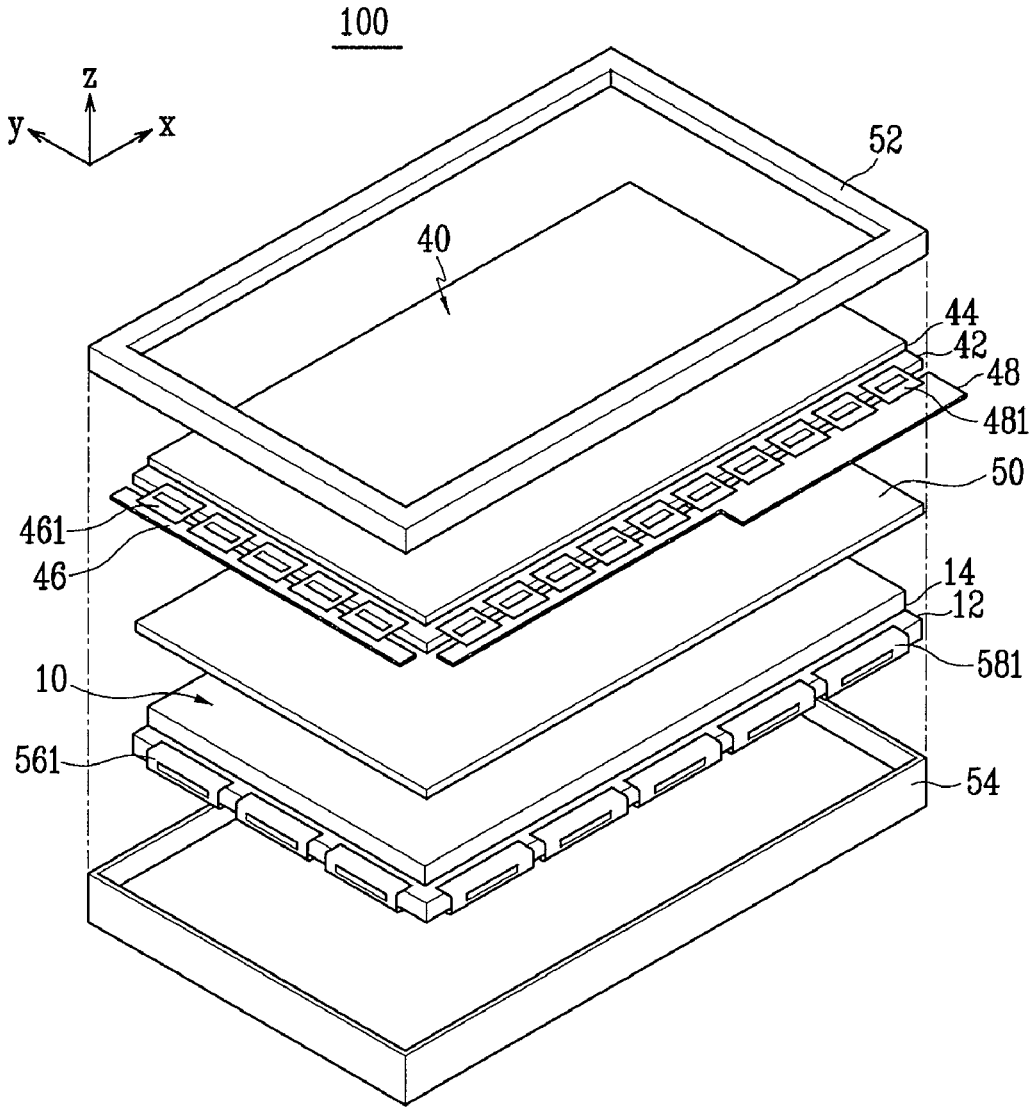
FIG. 8 is an exploded perspective schematic view of a display device according to an exemplary embodiment of the present invention.

FIG. 8 is an exploded perspective view of a display device using the above described light emission device of FIGS. 1 through 3 as a light source according to an exemplary embodiment of the present invention. A display device illustrated in FIG. 8 is only provided as an example, and the present invention is not thereby limited.

Referring to FIG. 8, a display device 100 includes a light emission device 10 and a display panel 40 located in front of (or on) the light emission device 10. A diffuser plate 50 for uniformly diffusing light emitted from the light emission device 10 to the display panel 40 may be located between the light emission device 10 and the display panel 40. The diffuser 50 is spaced apart from the light emission device 10 by a distance that may be predetermined.

The light emission device 10 having the above-described structure can enhance the luminance uniformity of the active area and thus the spaced distance between the light emission device 10 and the diffuser 50 can be reduced. The reduction of the spaced distance between the light emission device 10 and the diffuser 50 allows the display device 10 to be relatively thin (or slim) and reduces (or minimizes) the light loss caused by the diffuser 50, thereby increasing the light emission efficiency.

A top chassis 52 is located in front of (or on) the display panel 40 and a bottom chassis 54 is located in rear of (or under) the light emission device 10. A liquid crystal display panel or other passive type (non-emissive type) display panels may be used as the display panel 40. In the following description, a case where the display panel 40 is the liquid crystal display panel will be described in more detail as an example.

The display panel 40 includes a thin film transistor (TFT) panel 42 having a plurality of TFTs, a color filter panel 44 located above the TFT panel 42, and a liquid crystal layer formed between the panels 42 and 44. Polarizing plates are attached on a top surface of the color filter panel 44 and a bottom surface of the TFT panel 42 to polarize the light passing through the display panel 40.

Each of the TFTs has a source terminal connected to data lines, a gate terminal connected to gate lines, and a drain terminal connected to pixel electrodes formed of a transparent conductive material. When an electric signal is input from circuit board assemblies 46 and 48 to the respective gate and data lines, the electric signal is input to the gate and source terminals of the TFT and the TFT is turned on or off in accordance with the electric signal to output an electric signal required for driving the pixel electrodes to the drain terminal.

The color filter panel 44 includes RGB color filters for emitting colors (that may be predetermined) as the light passes through the color filter panel 44 and a common electrode formed of a transparent conductive material. When the TFT is turned on, an electric field is formed between the pixel electrode and the common electrode. A twisting angle of liquid crystal molecular between the TFT panel 42 and the color filter panel 44 is varied, in accordance of which, the light transmittance of the corresponding pixel is varied.

The circuit board assemblies 46 and 48 of the display panel 40 are respectively connected to driving IC packages 461 and 481. In order to drive the display panel 40, the gate circuit board assembly 46 transmits a gate driving signal and the data circuit board assembly 48 transmits a data driving signal.

The light emission device 10 includes a plurality of pixels, the number of which is less than the number of pixels of the display panel 40 so that one pixel of the light emission device 10 corresponds to two or more of the pixels of the display panel 40. Each pixel of the light emission device 10 emits the light in response to a highest gray level among gray levels of the corresponding pixels of the display panel 40. The light emission device 10 can represent a gray level ranging from 2 to 8 bits at each pixel.

For convenience, the pixels of the display panel 40 are referred as first pixels and the pixels of the light emission device 10 are referred as second pixels. The first pixels corresponding to one second pixel are referred as a first pixel group.

Describing a driving process of the light emission device 10, a signal control unit for controlling the display panel 40 detects the highest gray level of the first pixel group, operates a gray level required for emitting light from the second pixel in response to the detected high gray level, converts the operated gray level into digital data, and generates a driving signal of the light emission device 10 using the digital data. The driving signal of the light emission device 10 includes a scan driving signal and a data driving signal.

Scan and data circuit board assemblies of the light emission device 10 are respectively connected to driving IC packages 561 and 581. In order to drive the light emission device 10, the scan circuit board assembly transmits a scan driving signal and the data circuit board assembly transmits a data driving signal.

When an image is displayed on the first pixel group, the corresponding second pixel of the light emission device 10 emits light with a gray level that may be predetermined by synchronizing with the first pixel group. As described above, the light emission device 10 controls independently a light emission intensity of each pixel and thus provides a proper intensity of light to the corresponding pixels of the display panel 40. As a result, the display device 100 of the present exemplary embodiment can enhance the contrast ratio of the screen, thereby improving the display quality.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A light emission device comprising:

a first substrate and a second substrate facing the first substrate;

a plurality of first electrodes and a plurality of second electrodes located at a side of the first substrate facing the second substrate, the first electrodes crossing the second electrodes;

a plurality of electron emission regions electrically connected to the first electrodes at crossing regions where the first electrodes cross the second electrode;

a light emission unit located at a side of the second substrate facing the first substrate; and a spacer located between the first and second substrates, wherein a shortest distance D between the spacer and the electron emission regions satisfies the following condition:

$$500\ \mu m \leqq D \leqq 0.2Dh,$$

where, Dh is a diagonal length of at least one of the crossing regions.

2. The light emission device of claim 1, wherein the spacer has a height ranging from 5 to 20 mm.

3. The light emission device of claim 2, wherein the light emission unit includes an anode electrode applied with a voltage ranging from 10 to 15 kV and a phosphor layer on one side of the anode electrode.

4. The light emission device of claim 1, further comprising an insulation layer located between the first and second electrodes, wherein the second electrodes are located above the insulation layer, wherein a plurality of openings are formed in the second electrodes and the insulation layer at the crossing regions, and wherein the electron emission regions are disposed on the first electrodes in the openings of the insulation layer.

5. The light emission device of claim 4, wherein the spacer is located at an outer side portion of a diagonal corner of the at least one of the crossing regions.

6. The light emission device of claim 4, wherein the second electrodes are parallel to each other and spaced apart from each other by a distance ranging from 100 to 400 μm.

7. The light emission device of claim 6, wherein the insulation layer has a thickness ranging from 15 to 30 μm.

8. The light emission device of claim 7, wherein each of the openings formed in the insulation layer and the second electrodes has a diameter ranging from 30 to 50 μm.

9. A display device comprising:

a display panel for displaying an image; and a light emission device for emitting light toward the display panel, wherein the light emission device comprises:

a first substrate and a second substrate facing the first substrate;

a plurality of first electrodes and a plurality of second electrodes located at a side of the first substrate facing the second substrate, the first electrodes crossing the second electrodes;

a plurality of electron emission regions electrically connected to the first electrodes at crossing regions where the first electrodes cross the second electrode;

a light emission unit located at a side of the second substrate facing the first substrate; and a spacer located between the first and second substrates, wherein a shortest distance D between the spacer and the electron emission regions satisfies the following condition:

$$500\ \mu m \leqq D \leqq 0.2Dh,$$

where, Dh is a diagonal length of at least one of the crossing regions.

10. The display device of claim 9, wherein the spacer has a height ranging from 5 to 20 mm; and the light emission unit includes an anode electrode applied with a voltage ranging from 10 to 15 kV and a phosphor layer formed on one side of the anode electrode.

11. The display device of claim 9, further comprising an insulation layer located between the first and second electrodes, wherein the second electrodes are located above the insulation layer, wherein a plurality of openings are formed in the second electrodes and the insulation layer at the crossing regions, and wherein the electron emission regions are disposed on the first electrodes in the openings of the insulation layer.

12. The display device of claim 11, wherein the spacer is located at an outer side portion of a diagonal corner of the at least one of the crossing regions.

13. The display device of claim 11, wherein the second electrodes are parallel to each other and spaced apart from each other by a distance ranging from 100 to 400 μm.

14. The display device of claim 13, wherein the insulation layer has a thickness ranging from 15 to 30 μm; and each of the openings formed in the insulation layer and the second electrodes has a diameter ranging from 30 to 50 μm.

15. The display device of claim 9, wherein the display panel has a plurality of first pixels, and the light emission device has a plurality of second pixels, wherein the second pixels are less in number than the first pixels, and wherein an intensity of light emission of each of the second pixels is independently controlled.

16. A light emission device comprising:

a first substrate and a second substrate facing the first substrate;

a first electrode and a second electrode located at a side of the first substrate facing the second substrate, the first electrode crossing the second electrode;

a plurality of electron emission regions electrically connected to the first electrode at a crossing region where the first electrode crosses and the second electrode;

a light emission unit located at side of the second substrate facing the first substrate; and a spacer located between the first and second substrates, wherein a shortest distance D between the spacer and the electron emission regions satisfies the following condition:

$$500\ \mu m \leqq D \leqq 0.2Dh,$$

where, Dh is a diagonal length of the crossing region.

17. The light emission device of claim 16, further comprising an insulation layer located between the first and second electrodes, wherein the second electrode is located above the insulation layer, wherein a plurality of openings are formed in the second electrode and the insulation layer at the crossing region, and wherein the electron emission regions are disposed on the first electrode in the openings of the insulation layer.

* * * * *

UNITED STATES PATENT AND TRADEMARK OFFICE

CERTIFICATE OF CORRECTION

PATENT NO. : 7,737,620 B2
APPLICATION NO. : 11/746579
DATED : June 15, 2010
INVENTOR(S) : Jong-Hoon Shin et al.

It is certified that error appears in the above-identified patent and that said Letters Patent is hereby corrected as shown below:

On the Title Page

| | |
|---|---|
| (57) Abstract line 11 | After "substrates"<br>Delete ","<br>Insert -- . -- |

In the Claims

| | |
|---|---|
| Column 14, claim 16, line 6 | Delete "and" |
| Column 14, claim 16, line 7 | After "at"<br>Insert -- a -- |

Signed and Sealed this
Twenty-fifth Day of October, 2011

David J. Kappos

David J. Kappos
*Director of the United States Patent and Trademark Office*